US007234189B2

(12) United States Patent
Chen

(10) Patent No.: US 7,234,189 B2
(45) Date of Patent: Jun. 26, 2007

(54) CLEANING IMPLEMENT

(76) Inventor: Chi-Hung Chen, No. 3-3, Hsia-Yuan-Lin, Tieh-Hsi, Hsi-Kou Hsiang, Chia-Yi Hsien (TW)

( * ) Notice: Subject to any disclaimer, the term of this patent is extended or adjusted under 35 U.S.C. 154(b) by 178 days.

(21) Appl. No.: 11/184,091

(22) Filed: Jul. 19, 2005

(65) Prior Publication Data

US 2007/0017053 A1 Jan. 25, 2007

(51) Int. Cl.
*A47L 13/12* (2006.01)
*A47K 7/02* (2006.01)

(52) U.S. Cl. ..... 15/118; 15/244.3

(58) Field of Classification Search ..... 15/118, 15/244.3, 244.4
See application file for complete search history.

(56) References Cited

U.S. PATENT DOCUMENTS

2005/0202232 A1* 9/2005 Sauniere ..... 428/316.6
2006/0230569 A1* 10/2006 Chen ..... 15/244.3

FOREIGN PATENT DOCUMENTS

| | | | |
|---|---|---|---|
| DE | 2 340 445 | * | 2/1974 |
| JP | 6-341033 | * | 12/1994 |
| JP | 2000-126105 | * | 5/2000 |
| JP | 2002-201299 | * | 7/2002 |
| JP | 2004-360157 | * | 12/2004 |

* cited by examiner

*Primary Examiner*—Randall Chin
(74) *Attorney, Agent, or Firm*—Ostrolenk, Faber, Gerb & Soffen, LLP

(57) ABSTRACT

A cleaning implement includes a fabric layer made from a splittable conjugate fiber, a sponge wiper layer made of melamine foam, and a reinforcing layer made of a non-melamine foam material and disposed between the fabric and sponge layers. The non-melamine foam material has higher water-absorbing and elastic properties than the melamine foam.

3 Claims, 3 Drawing Sheets

CLEANING IMPLEMENT

BACKGROUND OF THE INVENTION

1. Field of the Invention

The invention relates to a cleaning implement, more particularly to a cleaning implement that can wipe off different kinds of dirt and stains.

2. Description of the Related Art

Referring to FIG. 1, a conventional cleaning sponge includes a sponge layer 12, and a fabric layer 11 superimposed on the sponge layer 12. The fabric layer 11 is made of nylon. During user manipulation of the conventional cleaning sponge, the fabric layer 11 and the sponge layer 12 remove stains by rubbing a surface of an article to be washed. However, since the fabric layer 11 is made of nylon, it cannot achieve a sufficient cleaning effect. Further, although the sponge layer 12 can absorb water, it also has a poor cleaning effect and is not durable.

SUMMARY OF THE INVENTION

Therefore, the object of the present invention is to provide a cleaning implement that can achieve a sufficient cleaning effect and that is durable.

According to this invention, a cleaning implement comprises a fabric layer made from a splittable conjugate fiber, a sponge wiper layer made of melamine foam, and a reinforcing layer made of a non-melamine foam material and disposed between said fabric and sponge layers. The non-melamine foam material has higher water-absorbing and elastic properties than the melamine foam. The conjugate fiber includes a substantially star-shaped polyester fiber component, and a plurality of nylon fiber components.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
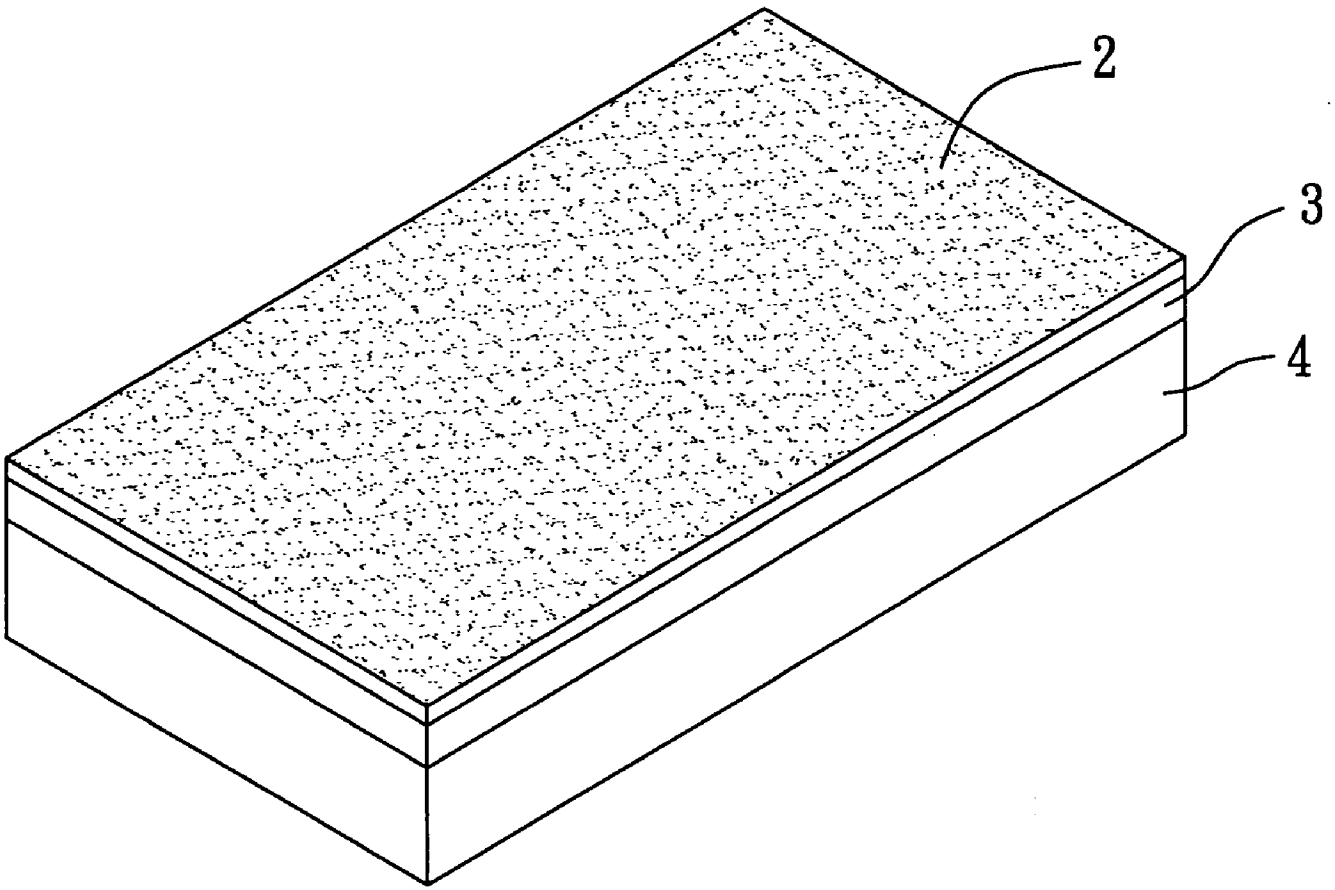
FIG. 2 is a perspective view of the preferred embodiment of a cleaning implement according to the present invention.
Figure 3:
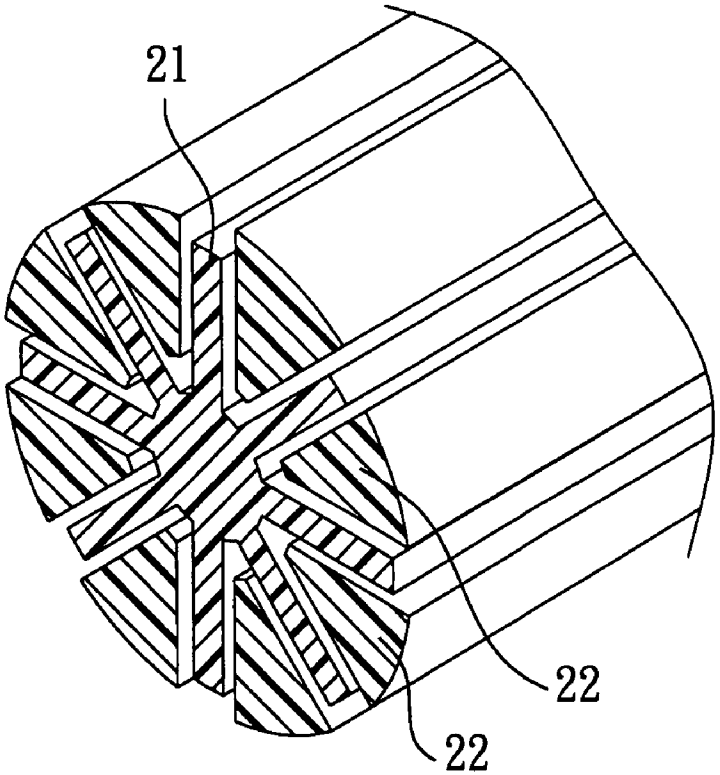
FIG. 3 is an enlarged perspective view of a conjugate fiber of the preferred embodiment.

Referring to FIGS. 2 and 3, the preferred embodiment of a cleaning implement according to the present invention is shown to comprise a fabric layer 2, a sponge wiper layer 4, and a reinforcing layer 3.

The fabric layer 2 includes a knitted fabric which is made from a splittable conjugate fiber. The conjugate fiber includes a substantially star-shaped polyester fiber component 21, and a plurality of nylon fiber components 22.

Figure 1:
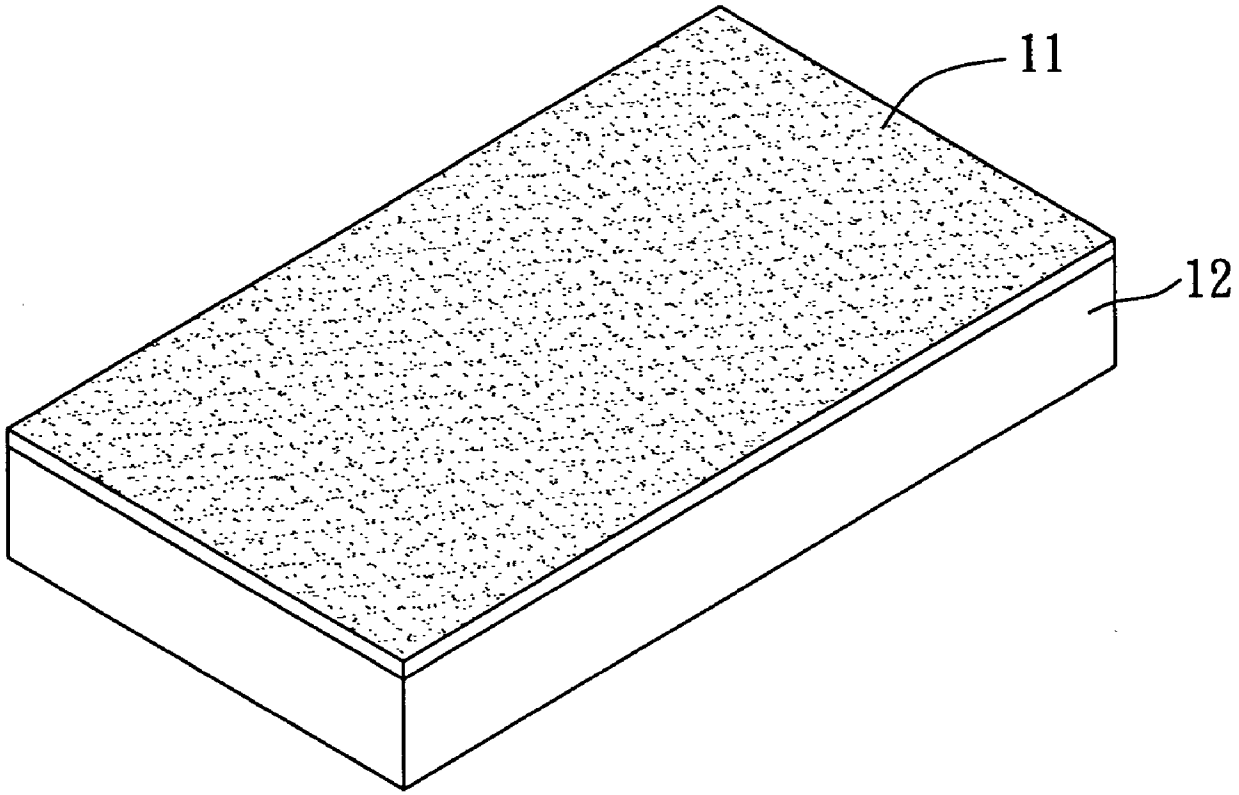
FIG. 1 PRIOR ART
FIG. 1 is a perspective view of a conventional cleaning sponge.

Because of the special structure of the conjugate fiber, the fabric layer 2 can easily remove dirt and stains as compared with the nylon fabric layer 11 (see FIG. 1) of the conventional cleaning sponge.

The sponge wiper layer 4 is made of melamine foam. The melamine foam has a greater cleaning ability than that of a foam material used commonly in the conventional cleaning sponge, and is effective at removing stubborn stains and dirt.

The reinforcing layer 3 is made of a non-melamine foam material, and is disposed between the fabric and sponge layers 2, 4. The non-melamine foam material has higher water-absorbing and elastic properties than the melamine foam. The non-melamine foam material is selected from the group consisting of polyurethane (PU), ethylene vinyl acetate (EVA), polyethylene (PE), nitrile butadiene rubber (NBR), and styrene butadiene rubber (SBR).

From the aforementioned description, the fabric layer 2 and the sponge layer 4 are made of specific materials so as to effectively remove dirt and stains. The reinforcing layer 3 is made of a foam material which has good elastic and water-absorbing properties. The elasticity of the reinforcing layer 3 enables the fabric layer 2 and the sponge layer 4 to stretch outwardly and be restored to their original shapes, thereby preventing the fabric layer 2 and the sponge layer 4 from deforming easily. Hence, the durability of the cleaning implement of the present invention is enhanced.

Further, in case the water content in the fabric layer 2 and the sponge layer 4 are lost during use, the reinforcing layer 3 will serve to supply water to these elements so that the rate of damage to the fabric layer 2 and the sponge layer 4 is minimized, thereby prolonging the service life of the cleaning implement of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A cleaning implement comprising:

a fabric layer made from a splittable conjugate fiber, said conjugate fiber includes a substantially star-shaped polyester fiber component, and a plurality of nylon fiber components, a sponge wiper layer made of melamine foam; and a reinforcing layer made of a non-melamine foam material and disposed between said fabric and sponge layers, the non-melamine foam material having higher water-absorbing and elastic properties than the melamine foam.

2. The cleaning implement of claim 1, wherein the non-melamine foam material is selected from the group consisting of polyurethane (PU), ethylene vinyl acetate (EVA), polyethylene (PE), nitrile butadiene rubber (NBR), and styrene butadiene rubber (SBR).

3. The cleaning implement of claim 1, wherein said fabric layer includes a knitted fabric.

* * * * *